United States Patent [19]

Clement

[11] 4,293,389

[45] Oct. 6, 1981

[54] DOOR CLOSURE CONSTRUCTION FOR SEALING THE SEALING EDGE OF A COKE OVEN DOOR IN A FRAMED COKE OVEN OPENING

[75] Inventor: Heinrich-Josef Clement, Oer-Erkenschwick, Fed. Rep. of Germany

[73] Assignee: Firma Carl Still GmbH & Co. KG, Fed. Rep. of Germany

[21] Appl. No.: 150,361

[22] Filed: May 16, 1980

[30] Foreign Application Priority Data

May 17, 1979 [DE] Fed. Rep. of Germany ..... 7914228

[51] Int. Cl.[3] ..... C10B 25/06

[52] U.S. Cl. ..... 202/248; 110/173 R

[58] Field of Search ..... 202/242, 248, 269; 110/173 R

[56] References Cited

U.S. PATENT DOCUMENTS 4,036,702 7/1977 Nagayoshi ..... 110/173 R 4,110,173 8/1978 Dix ..... 202/248

FOREIGN PATENT DOCUMENTS 1267664 5/1968 Fed. Rep. of Germany .

*Primary Examiner*—Frank W. Lutter

*Assistant Examiner*—Roger F. Phillips

*Attorney, Agent, or Firm*—McGlew and Tuttle

[57] ABSTRACT

A door closure construction for sealing the sealing edge of a coke oven door in a coke oven having an opening with an outer rigid frame bounding the opening, comprises an adjustable inner frame which fits into a recess of the outer frame and may be adjustably positioned in respect thereto and in respect to the sealing edge of the coke oven door.

2 Claims, 3 Drawing Figures

8
9
3
10
11
13
4
2
12
2b
2a
19
1
5
7
30
1a
50
2c
6
24
21
22
20
16
23
17
18
15
14

1
2
3

1
2
3

DOOR CLOSURE CONSTRUCTION FOR SEALING THE SEALING EDGE OF A COKE OVEN DOOR IN A FRAMED COKE OVEN OPENING

FIELD AND BACKGROUND OF THE INVENTION

This invention relates in general to the construction of coke ovens and in particular to a new and useful coke oven door closure in which a coke oven door having a spring bias sealing edge engages against an inner sealing frame part which adjustable fitted into a corner recess of an outer rigid frame part of the coke oven.

The seals on doors of horizontal coke ovens usually have sealing edges which are provided on the outer ribs of the door body and are pressed against the sealing surface of the door frame. In prior art door sealing arrangements, the sealing edges are either designed as so-called peen strips which are clamped to the door body and, if the surfaces to be brought into contact are not quite even, are peened against the sealing surfaces of the door frame to obtain a tight seal, or they are resilient and are pressed into contact with the sealing surfaces by springs. It is also known to make this spring force adjustable (German Utility Model 7705417.2). Due to such a slight deformation or resilience of the sealing edges, small unevenesses caused, for example, by non-removed tar deposits between the sealing edge and the sealing surface, can be compensated. However, the possibilities of conformation are limited, since substantially an edgewise contact is established. Also, the adjusted spring force varies with the distance and can be readjusted only to a small extent.

As the development of coke ovens advances with still higher oven chambers and doors, experience has shown that it becomes more and more difficult to compensate for door body or door frame deformations caused by mechanical or thermal loads. During operation, the door or frame deform relative to each other to the effect that the upper and lower ends of the doors protrude outwardly, while those of the frame bend inwardly, toward the masonry.

It is known from German Pat. No. 1267664 to use a two part door frame in which the inner part projects outwardly up to the plane of the sealing surface provided on the outer part, and the two parts are thermally insulated against each other and against the masonry of the oven. By providing sealing material between the two frame parts and the masonry, formation of tar and pitch condensates and their hardening under the heat from the oven chamber is to be reduced. Experience has shown, however, that such tar or pitch deposits cannot be completely prevented. The two door frame parts are firmly secured to each other and held in position by the anchoring posts as a rigid, immovable unit.

SUMMARY OF THE INVENTION

The invention is directed to a sealing device on doors of horizontal coke ovens which makes it possible to compensate for even larger deformations of door bodies and door frames without any problems and ensures a secure and lasting seal.

To this end and in accordance with the invention, it is provided that the door frame is assembled of an outer, rigid frame part which is firmly sealed against the refractory masonry, and an inner frame part which can be inserted into the outer frame part and is connected thereto with screws, for example, and is displaceable relative to the outer frame part, in oblong slots, for example, in the direction of the sealing edge of the door body. The inner, sealing frame part is designed as a part which is deformable to the extent that upon loosening the fixing screws, it can be moved by means of a simple tool (for example, a T bar) and through some centimeters at most, in the direction of the sealing edge of the door body or in an opposite direction.

It has proved advantageous in the inventive design, to keep the two frame parts in spaced-apart relationship in the area of the fixing screws, by means of exchangeable spacers having unequal thicknesses. Then, there is no need for tightening the screws to an extent preventing the lateral displacement of the inner frame part. The contact pressure of the sealing edge is transmitted directly through the spacers to the outer frame part and the masonry.

The primary advantage of this novel sealing device on doors of horizontal coke ovens are that both the door body itself and the outer door frame part are rigid structures resistant to bending, and that deformations, for example, due to temperature differences in the steel sections, which can hardly be avoided, particularly in high doors, are compensated by the displaceable inner sealing frame part.

Accordingly it is an object of the invention to provide a closure construction for sealing a coke oven door with a sealing edge in a coke oven opening having a frame part which is rigidly attached to the refractory masonry and which has a corner recess for receiving an adjustable sealing frame part and a means for adjustably positioning the sealing frame part in association with the outer frame part in respect to the sealing edge of the door.

A further object of the invention is to provide a door closure construction which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF PREFERRED EMBODIMENT

Figure 1:
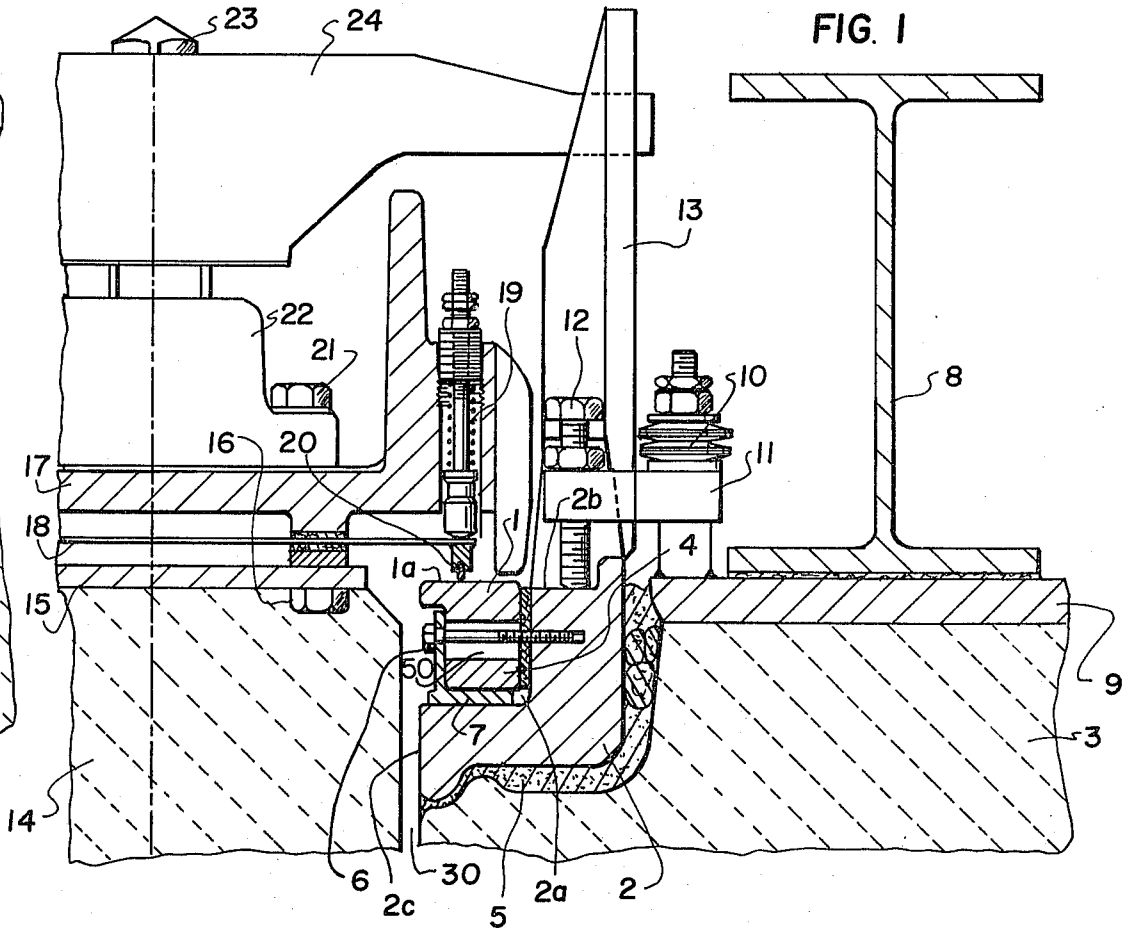
FIG. 1 is a partial horizontal sectional view of a coke oven door closure constructed in accordance with the invention.

Referring to the drawings in particular, the invention embodied therein comprises a closure construction for sealing a coke oven having refractory masonry 3 with an opening 30 for a coke oven door which includes a body portion 17 and a stopper portion 14 which extends into the opening 30.

In accordance with the invention the coke oven is provided with an outer rigid frame part 2 which is firmly sealed against the refractory masonry 3 such as by sealing material 5 and which is provided with a corner recess 2*a* which is cut into a front face 2*b* and a side face 2*c* of the inner frame 2. The recess accommodates an inner adjustable sealing frame member 1 which has an outer surface 1*a* which is engaged by a sealing edge 20 of the door body 17. In accordance with a feature of the invention the inner door frame part 1 is adjustably fitted to the rigid door frame part 2 by means of a connecting element 6 and 7 in the form of a fastening bolt 6 and a spacer 7. Connection means 6 and 7 permit the spring to be adjusted relative to the sealing edge 20 so that the door frame will be sealed all around at its periphery.

Figure 3:
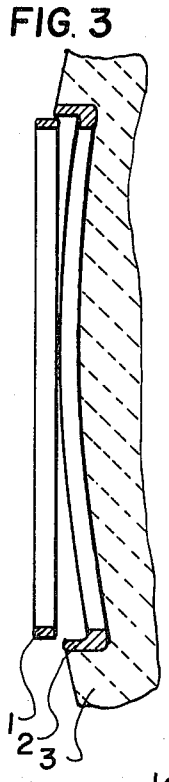
FIG. 3 is a view similar to FIG. 2 but showing the construction of the invention in which a movable inner door frame part is aligned to the rigid outer door frame part into the vertical position.
Figure 2:
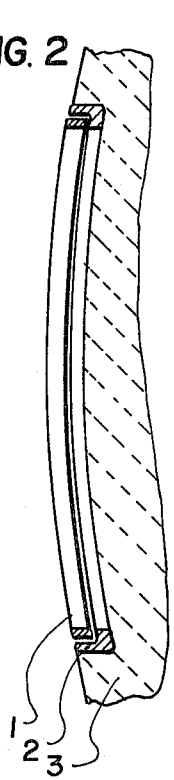
FIG. 2 is a schematic sectional view showing the interrelationship of the door frame parts and how they deform in front of the masonry.

The figures show the inner door frame part 1 and the outer door frame part 2. Part 2 is inserted, with the interposition of sealing or packing material 5, into corresponding recesses provided in oven head refractory masonry 3, and held in place by anchoring posts 8 through supporting elements 9 to 12. Inner frame part 1 is firmly connected to the outer frame part 3 by fixing screws or bolts 6 which are distributed over the entire periphery of the annular frame part, and extend through resilient packings 4. The position of the inner frame part 1 is adjustable due to oblong slots 50 in the frame part 1, as indicated in FIGS. 2 and 3. The interspace between the two parts 1 and 2, which varies along the height, is filled out with conformable rigid spacers 7, so that upon pressing sealing edge 20 into contact with the inner frame part 1, it cannot yield.

When a stopper portion 14 is inserted in the coke oven chamber aperture 30 (see FIG. 1), coke oven door body 17 is fixed in place by means of conventional dogs 24 pivoted on thread bolts 23 and engaging in hooks 13 which are secured to the outer frame part 2. Thread bolts 23 are secured to the door body 17 through a casing 22 and screws 21.

As is well known, the door comprises an iron stopper support 15 for supporting the refractory door stopper 14, and a door body 17 which is screwed to stone support 15 by screws 16. Between stone support 15 and door body 17, a central thin diaphragm 18 is provided which extends over the entire surface area of the door and is also held in place by screws 16. At the side of diaphragm sheet 18 facing the sealing surface of inner door frame part 1, the sealing edge 20 extends along the entire periphery of the door and is pressed into contact with the sealing surface of the inner frame part by means of springs 19 which are supported laterally on the door body 17 and are adjustable in their biasing pressure.

While a specific embodiment of the invention has been shown and described in detail to illustrate the application of the principles of the invention, it will be understood that the invention may be embodied otherwise without departing from such principles.

What is claimed is:

1. An improved sealing device for a coke oven of the type having an opening, a door and a door sealing frame for closing the opening, the door having a door body and a sealing edge extending along the periphery of the door body, the door sealing frame being of the type having a fixed outer frame and an inner frame inserted within and mounted to the outer frame, and the inner frame having a sealing surface adapted to sealingly receive the sealing edge of the door body, the improvement comprising means for adjustably mounting the inner frame to the outer frame in spaced-apart relationship therefrom to define a spacing therebetween, said adjusting means including screw means for detachably connecting the inner frame to the outer frame, and a plurality of spacers having unequal thickness exchangeably mounted within said spacing to maintain the inner and outer frame in said spaced-apart relationship.

2. A door closure according to claim 1, wherein said spacers further comprise a spacer having an L-shaped configuration, said spacer including an upstanding part, and wherein said inner frame has an oblong slot disposed behind said upstanding part, and said screw means comprises a bolt extending through said upstanding part and through said oblong slot into engagement with said outer frame.

* * * * *